US007852987B2

(12) United States Patent
Al-Sadah et al.

(10) Patent No.: US 7,852,987 B2
(45) Date of Patent: Dec. 14, 2010

(54) X-RAY TUBE HAVING A ROTATING AND LINEARLY TRANSLATING ANODE

(75) Inventors: Jihad Hassan Al-Sadah, Dhahran (SA); Ezzat Abbas Mansour, Dhahran (SA); Nabil Maalej, Dhahran (SA)

(73) Assignee: King Fahd University of Petroleum and Minerals (SA)

( * ) Notice: Subject to any disclaimer, the term of this patent is extended or adjusted under 35 U.S.C. 154(b) by 0 days.

(21) Appl. No.: 12/453,655

(22) Filed: May 18, 2009

(65) Prior Publication Data

US 2010/0290594 A1 Nov. 18, 2010

(51) Int. Cl.
*H01J 35/08* (2006.01)

(52) U.S. Cl. ..... 378/126; 378/143

(58) Field of Classification Search ..... 378/143–144, 378/119, 121, 125, 126, 137
See application file for complete search history.

(56) References Cited

U.S. PATENT DOCUMENTS

| | | | | |
|---|---|---|---|---|
| 1,192,706 | A | 7/1916 | Thomson | |
| 1,211,092 | A | 1/1917 | Coolidge | |
| 1,621,926 | A | 3/1927 | Fujimoto | |
| 1,917,099 | A | 7/1933 | Coolidge | |
| 1,946,312 | A | 2/1934 | Coolidge | |
| 2,926,270 | A | 2/1960 | Zunick | |
| 3,398,307 | A | 8/1968 | Brown et al. | |
| 3,646,380 | A | 2/1972 | Hartl | |
| 3,836,805 | A | 9/1974 | Kok | |
| 4,300,051 | A | 11/1981 | Little | |
| 4,399,551 | A | 8/1983 | Grady | |
| 4,433,431 | A | 2/1984 | Pfeiler | |
| 4,658,414 | A | 4/1987 | Geldner | |
| 4,689,809 | A | 8/1987 | Sohval | |
| 5,305,363 | A | 4/1994 | Burke et al. | |
| 6,522,721 | B1 | 2/2003 | Lustberg | |
| 6,778,633 | B1 | 8/2004 | Loxley et al. | |
| 7,012,989 | B2 | 3/2006 | Holland et al. | |
| 7,248,672 | B2 | 7/2007 | Durst et al. | |
| 7,305,063 | B2 * | 12/2007 | Heuscher | 378/12 |
| 7,305,066 | B2 | 12/2007 | Ukita | |
| 7,315,610 | B2 | 1/2008 | Freudenberger et al. | |

* cited by examiner

*Primary Examiner*—Courtney Thomas
(74) *Attorney, Agent, or Firm*—Richard C. Litman

(57) ABSTRACT

The X-ray tube having a rotating and linearly translating anode includes an evacuated shell having a substantially cylindrical anode rotatably mounted therein. The substantially cylindrical anode may be rotated through the usage of any suitable rotational drive, and the substantially cylindrical anode is further selectively and controllably linearly translatable about the rotating longitudinal axis thereof. A cathode is further mounted within the evacuated shell for producing an electron beam that impinges on an outer surface of the substantially cylindrical anode, thus forming a focal spot thereon. X-rays are generated from the focal spot and are transmitted through an X-ray permeable window formed in the evacuated shell.

6 Claims, 5 Drawing Sheets

X-RAY TUBE HAVING A ROTATING AND LINEARLY TRANSLATING ANODE

BACKGROUND OF THE INVENTION

1. Field of the Invention

The present invention relates to radiographic equipment, and particularly, to an X-ray tube having a rotating and linearly translating anode.

2. Description of the Related Art

An X-ray tube is a vacuum tube that produces X-rays, typically found in medical X-ray machines and the like. As with any vacuum tube, there is an emitter, typically a filament cathode, which emits electrons into the vacuum, and an anode to collect the electrons, thus establishing a flow of electrical current, referred to as the "beam", through the tube. A high voltage power source, for example 30 to 150 kV), is connected across the cathode and anode to accelerate the electrons. The X-ray spectrum produced depends on the anode material and the accelerating voltage.

Electrons from the cathode collide with a target deposited on the anode, with the target often formed from tungsten, molybdenum or copper. During collisions, the electrons lose energy in both collisional and radiative modes. About 1% of the kinetic energy during the collision process is converted into X-ray radiation. This is due to the deceleration of the electrons within the electrical field of the nucleus, or through the creation of vacancies in the inner shells of bound electrons.

FIG. 2 illustrates a typical, prior art Coolidge X-ray tube 100, also referred to as a "hot cathode tube". The Coolidge tube 100 is a vacuum tube, typically formed from a glass shell 104, having a vacuum formed therein, typically along the order of approximately $10^{-4}$ Pa or $10^{-6}$ Torr. In the Coolidge tube 100, electrons are produced via the thermionic effect from a tungsten filament 102 heated by an electric current (shown in FIG. 2 as being produced by voltage source $V_H$). The filament 102 forms the cathode of the tube 100. A high voltage potential is produced between the cathode and an anode 106 of the tube (produced in FIG. 2 by high voltage source $V_{C-A}$), so that the electrons generated by filament 102 are accelerated toward anode 106, and then strike the anode 106 to produce X-rays X. In FIG. 2, the Coolidge tube 100 is shown as also including a cooling device 108, with a water inlet $W_{in}$ and a water outlet $W_{out}$, for cooling the anode 106, which heats during X-ray production.

Coolidge tubes are formed as either end-window tubes or side-window tubes. In an end-window tube, the filament is wrapped about the anode, so the electrons have a curved path. The tube 100 of FIG. 2 is a side-window tube. In side-window tubes, an electrostatic lens is used to focus the beam onto a very small spot on the anode 106. The anode 106 is specially designed to dissipate the heat and wear resulting from this intense focused barrage of electrons. The anode is precisely angled at between 1 and 20° off perpendicular to the electron current so as to allow escape of some of the X-ray photons X which are emitted essentially perpendicular to the direction of the electron current. The anode is typically made from tungsten or molybdenum. Further, the tube has a window designed for escape of the generated X-ray photons. The input power of a typical Coolidge tube usually ranges from between 1 and 4 kW. Exemplary Coolidge X-ray tubes are shown in U.S. Pat. Nos. 1,211,092; 1,251,388; 1,917,099; and 1,946,312, each of which is hereby incorporated by reference in its entirety.

FIG. 3 illustrates a typical, prior art rotating anode tube 200. The rotating anode tube is an improvement of the Coolidge tube. Because X-ray production is very inefficient (99% of incident energy is converted to heat), the dissipation of heat at the focal spot of the electron beam is one of the main limitations on the power which can be applied. By sweeping the anode past the focal spot, the heat load can be spread over a larger area, greatly increasing the power rating. With the exception of dental X-ray tubes, almost all medical X-ray tubes are of this type.

The rotating anode tube 200 is also a vacuum tube, formed from shell 202 having an X-ray window 210 formed therein. The anode 204 consists of a disc with an annular target 206 formed thereon. The anode disc 204 is supported on an axle 214, which is supported by bearings 212 within the tube shell 202. The anode 204 can then be rotated by electromagnetic induction from a series of stator windings outside the evacuated tube.

Because the entire anode assembly has to be contained within the evacuated tube shell 202, heat removal is a serious problem, further exacerbated by the higher power rating available. Direct cooling by conduction or convection, as in the Coolidge tube, is difficult. In most tubes, the anode 204 is suspended on ball bearings with silver powder lubrication, which provides almost negligible cooling by conduction.

The anode 204 must be constructed of high temperature materials. The focal spot temperature caused by electrons generated by cathode 208 impinging upon target 206 can reach 2500° C. during an exposure, and the anode assembly can reach 1000° C. following a series of large exposures. Typical materials used to form the anode are a tungsten-rhenium target 206 on a molybdenum core, backed with graphite. The rhenium makes the tungsten more ductile and resistant to wear from impact of the electron beams. The molybdenum conducts heat from the target. The graphite provides thermal storage for the anode, and minimizes the rotating mass of the anode.

Increasing demand for high-performance CT scanning and angiography systems has driven development of very high performance medical X-ray tubes. Contemporary CT tubes have power ratings of up to 100 kW and anode heat capacity of 6 Mj, yet retain an effective focal spot area of less than 1 $mm^2$. Exemplary rotating anode X-ray tubes are shown in U.S. Pat. Nos. 1,192,706; 1,621,926; and 3,646,380, each of which is hereby incorporated by reference in its entirety.

In typical X-ray tubes, such as those described above, approximately 1% of the energy of the electron beam is converted to useful X-ray radiation, with 99% of the energy being lost as thermal energy. Thermal loss is of particular importance in high definition imaging, in which the electron beam must be focused on as small a target area as possible over a time period that is as short as possible. Image resolution depends upon both factors in diagnostic X-ray systems. Thermal energy gain within the target is a serious obstacle to the reduction of electron beam size or shortened exposure time.

Excess heat may be removed via conduction, as described above with reference to Coolidge tube 100, or the problem of instantaneous heating may be at least partially controlled by rotating the anode, as in rotating anode tube 200. Such solutions, however, only offer one degree of freedom in heat spreading. It would be desirable to provide an X-ray tube that can provide two degrees of freedom of heat dissipation, allowing for much higher instantaneous power limits.

Thus, an X-ray tube having a rotating and linearly translating anode solving the aforementioned problems is desired.

SUMMARY OF THE INVENTION

The X-ray tube having a rotating and linearly translating anode includes an evacuated shell having a substantially cylindrical anode rotatably mounted therein. The substantially cylindrical anode may be rotated through the use of any suitable rotational drive, and the substantially cylindrical anode is further selectively and controllably linearly translatable about the rotating longitudinal axis thereof. A cathode is mounted within the evacuated shell for producing an electron beam that impinges on an outer surface of the substantially cylindrical anode, thus forming a focal spot thereon. X-rays are generated from the focal spot and are transmitted through an X-ray permeable window formed in the evacuated shell.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
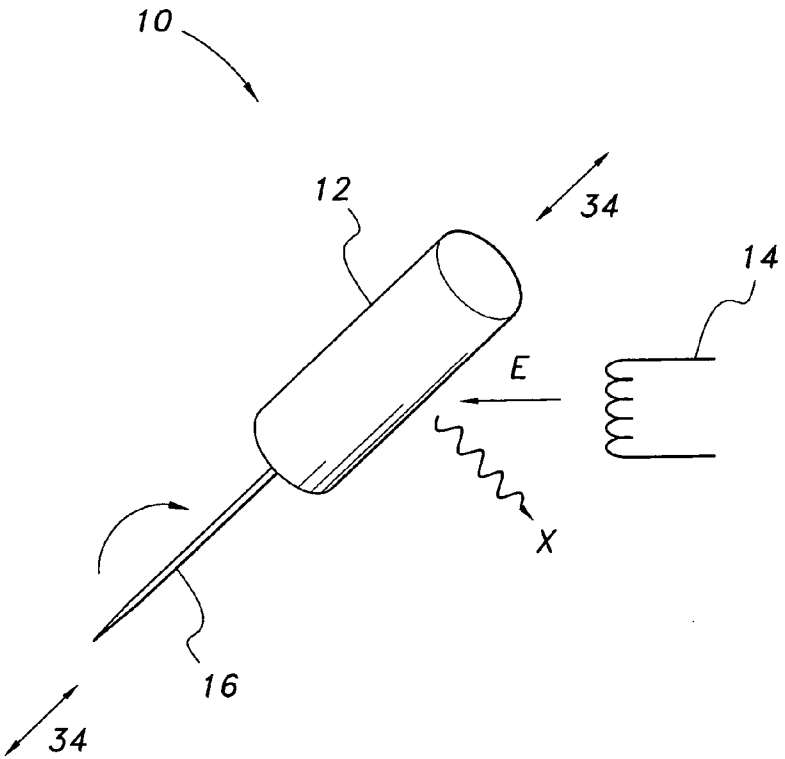
FIG. 1 is a simplified, diagrammatic view of an X-ray tube having a rotating and linearly translating anode according to the present invention.
Figure 2:
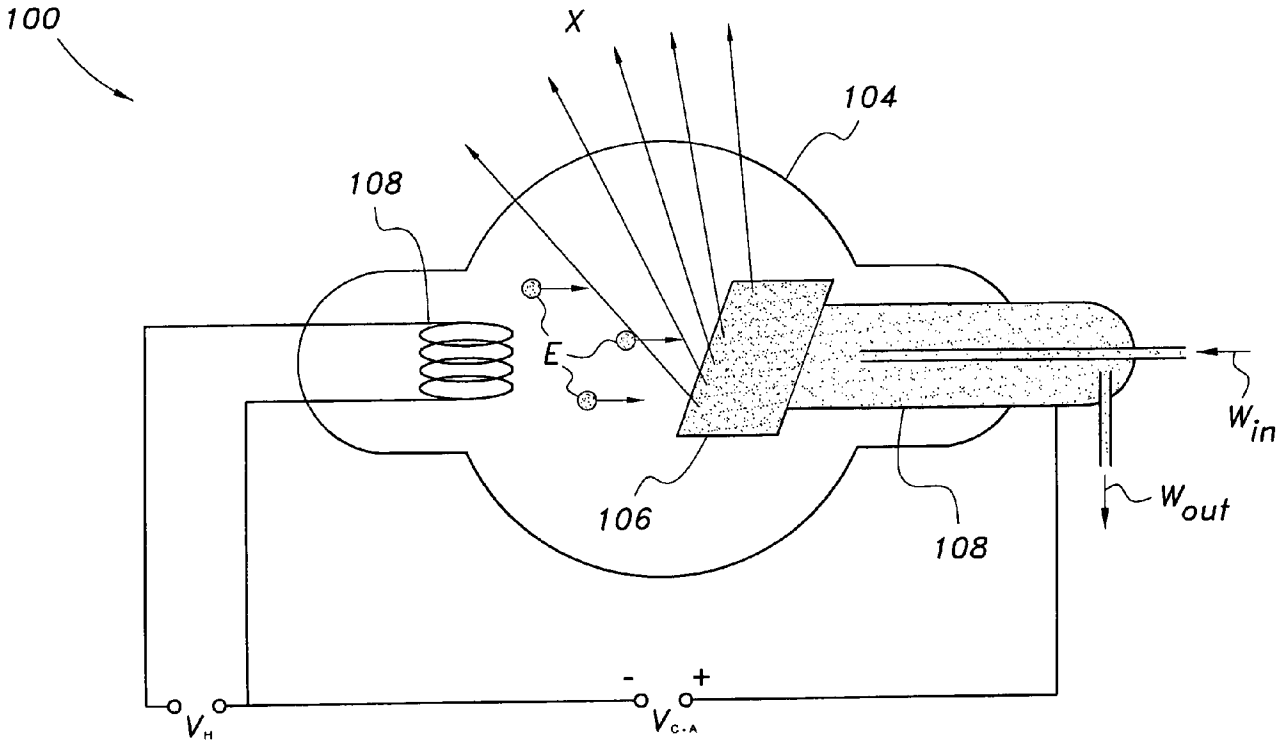
FIG. 2 PRIOR ART
FIG. 2 is a diagrammatic view of a prior art Coolidge X-ray tube.

Now referring to FIG. 1, an X-ray tube having a rotating and linearly translating anode is designated generally as 10. The X-ray tube 10 operates in a manner similar to Coolidge tube 100 of FIG. 2 and the rotating anode tube 200 of FIG. 3. Although shown diagrammatically, it should be understood that the tube 10 includes the conventional evacuated shell, high voltage power source, etc. described above with reference to tubes 100, 200. The exemplary X-ray tubes described above in U.S. Pat. Nos. 1,211,092; 1,251,388; 1,917,099; 1,946,312; 1,192,706; 1,621,926; and 3,646,380 are all hereby incorporated by reference in their entireties.

Figure 3:
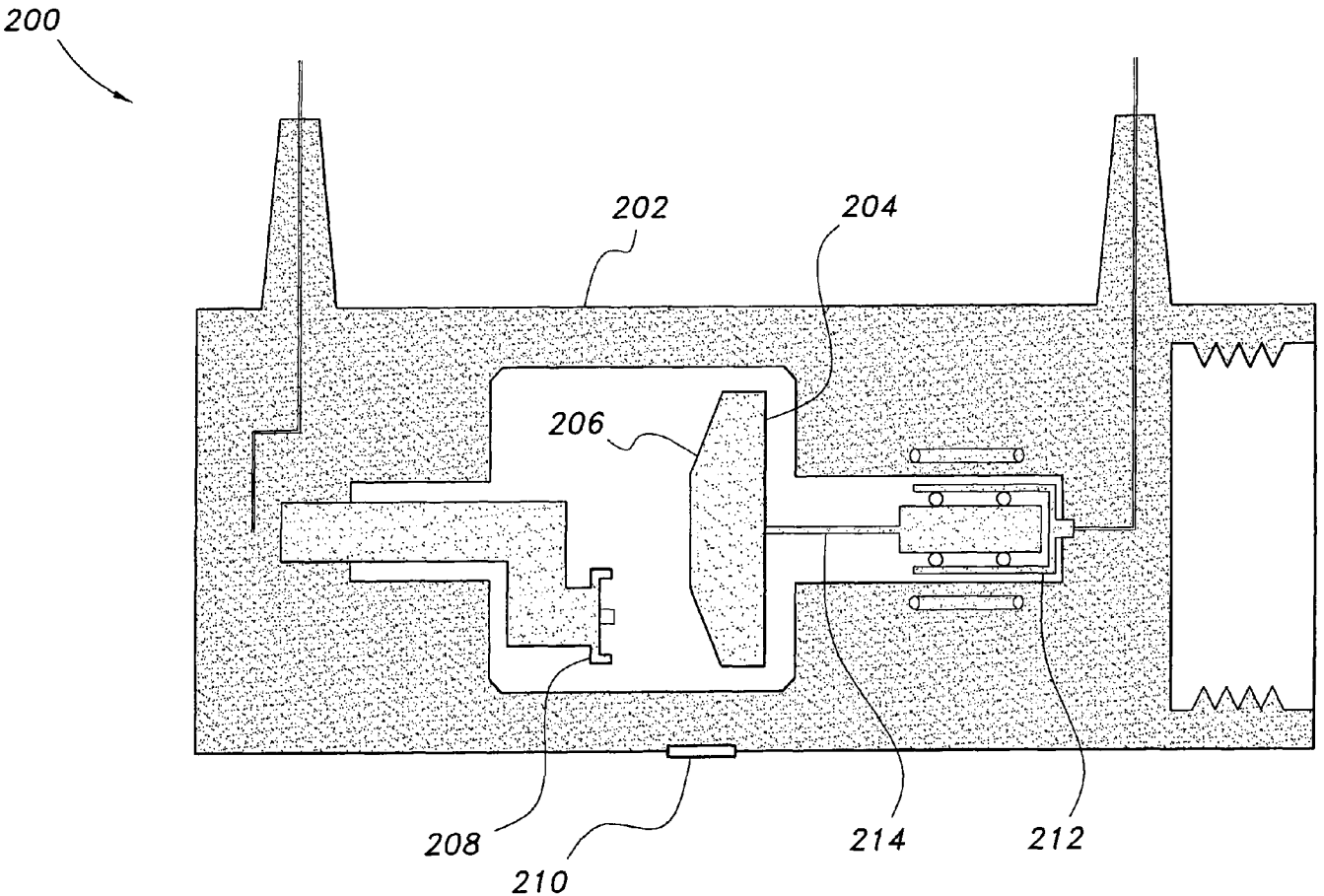
FIG. 3 PRIOR ART
FIG. 3 is a diagrammatic view of a prior art rotating anode X-ray tube.

As shown, tube 10 includes a cathode 14 that emits an electron beam E. Electron beam E impinges upon anode 12 to form X-rays X. Anode 12 is mounted on a rotating shaft 16, as in the prior art rotating anode tube 200. As shown in FIG. 3, a typical anode in a rotating anode tube is formed having a substantially frustoconical shape. Preferably, anode 12 of tube 10 has a cylindrical shape. The cylindrical shape of anode 12 allows for easier and more efficient adjustment and control over the angle of incidence between the target surface of anode 12 and the electron beam E. X-ray generation utilizing an anode that is both rotatable and linearly translatable is known. One such system is shown in U.S. Pat. No. 3,836,805, which is herein incorporated by reference in its entirety. This reference, however, teaches the usage of a hollow anode shell, which is necessary due to the inclusion of a temperature sensor. However, as best shown in FIG. 1, anode 12 preferably is formed as a solid cylinder that is coaxial with the axis of rotation. By forming the anode as a solid piece, anode 12 has a greater heat capacity than that found in shell-type anodes.

Figure 5:
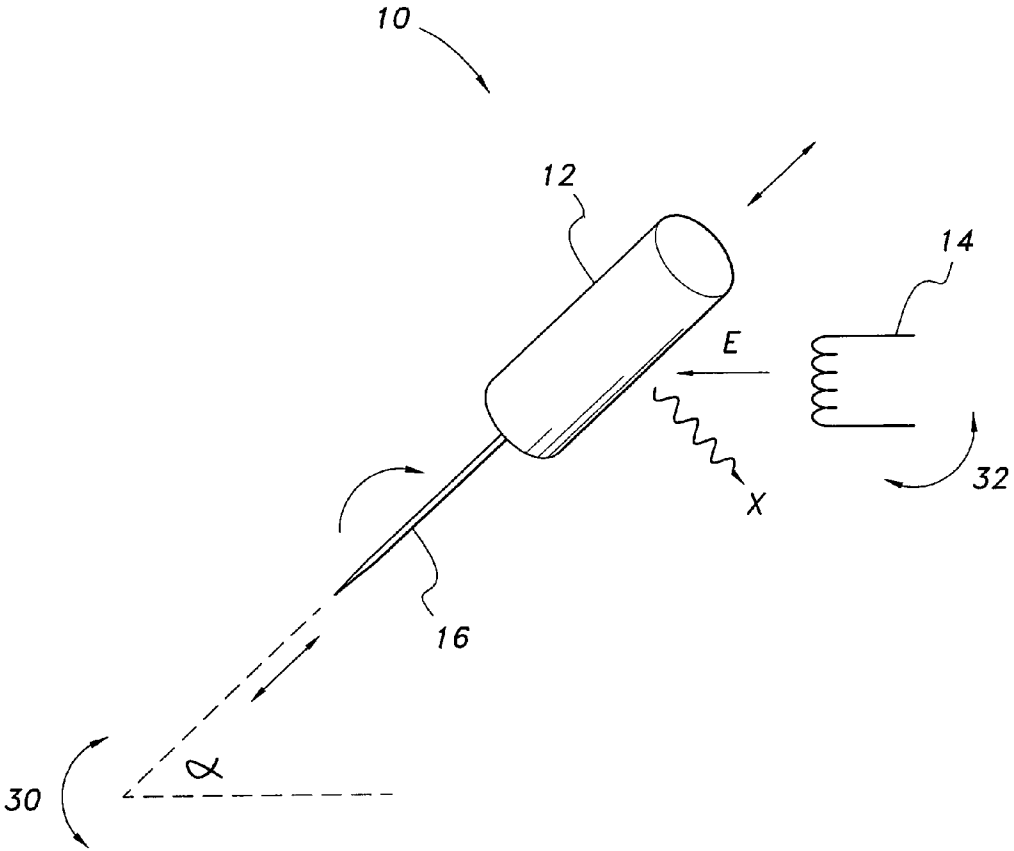
FIG. 5 is a simplified, diagrammatic view of another alternative embodiment of an X-ray tube having a rotating and linearly translating anode according to the present invention.

As best shown in FIG. 5, the shaft 16 is positioned at an angle $\alpha$ with respect to the horizontal. As indicated by the directional arrow 30, shaft 16 may preferably be rotated, allowing angle $\alpha$ to be selectively controlled by the user. Shaft 16 may be attached to any suitable motor or other rotating device, allowing the user to control the angle of incidence of the beam. Alternatively, as indicated by directional arrows 32, the cathode 14 may be similarly mounted on any suitable rotating structure to selectively control the angle of electron beam incidence. This rotation further allows for user control over effective focal spot size, power loading and field coverage. The focal spot size may be further controlled through the addition of electrostatic or magnetic lenses.

Returning to FIG. 1, in addition to rotation about the axis of shaft 16, the cylindrical anode 12 may also be linearly translated along the direction of the axis of shaft 16 (indicated by arrows 34). In the rotating anode 204 of prior art tube 200, the electron beam strikes only along an annular path, thus causing heating and loss of target material along this singular, circular path. In tube 10, the anode 12 is both rotated and linearly translated, thus allowing for heat dissipation and target impingement along the entire surface of the anode 12. With such controlled rotation and translation, the relative lifetime of the anode 12 is increased, the scan time is decreased, and the focal spot size may also be decreased. The shaft 16 may be driven to selectively and controllably rotate via connection to any suitable source of rotational power, such as a controllable motor or the rotating system described with reference to tube 200 of FIG. 3. The shaft 16 may also be driven to linearly translate along its axis in either direction in a controllable manner via mounting on any suitable source of linear motion, such as a controllable linear actuator or the like, or by means for translating rotational motion into linear motion, as is well-known in the art of sewing machines.

Figure 4:
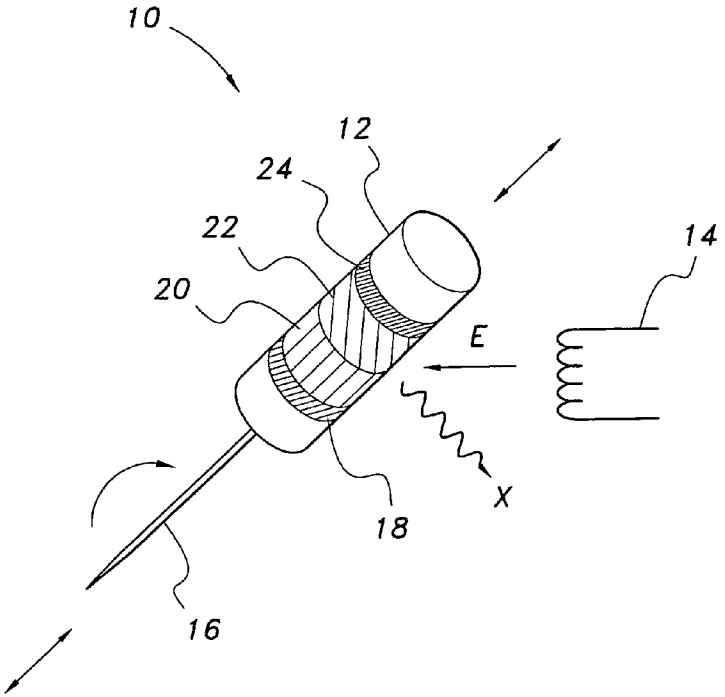
FIG. 4 is a simplified, diagrammatic view of an alternative embodiment of an X-ray tube having a rotating and linearly translating anode according to the present invention.

As a further alternative, multiple bands of differing target materials may be formed on the surface of anode 12. In FIG. 4, four such exemplary bands 18, 20, 22, 24 are shown, although it should be understood that any desired number of bands having any desired thickness and dimensions may be applied. By linearly translating the anode 12, as described above, the user may select the target material to be struck by electron beam E, thus being able to control the frequency and intensity of X-rays X being produced.

It is to be understood that the present invention is not limited to the embodiments described above, but encompasses any and all embodiments within the scope of the following claims.

We claim:

1. An X-ray tube, comprising:

an evacuated shell having an X-ray permeable window formed therein;

a substantially cylindrical, solid anode rotatably mounted within the evacuated shell, the anode defining a longitudinal axis, wherein the longitudinal axis of said substantially cylindrical anode is selectively angularly adjustable with respect to the horizontal;

means for rotating the anode about the longitudinal axis thereof;

means for selectively and controllably translating the anode linearly along the longitudinal axis;

a cathode selectively producing an electron beam impinging on an outer surface of the anode, forming a focal spot thereon so that X-rays are generated therefrom and are transmitted through the X-ray permeable window formed in the evacuated shell.

2. The X-ray tube as recited in claim 1, further comprising at least two different target materials formed on the outer surface of said substantially cylindrical anode, each said target material forming an annular band thereon.

3. The X-ray tube as recited in claim 1, wherein said means for selectively and controllable linearly translating the anode along the longitudinal axis comprises means for translating rotational motion into linear motion.

4. An X-ray tube, comprising:

an evacuated shell having an X-ray permeable window formed therein;

a substantially cylindrical, solid anode rotatably mounted within the evacuated shell, the anode defining a longitudinal axis, wherein the longitudinal axis of said substantially cylindrical anode is selectively angularly adjustable with respect to the horizontal;

at least two different target materials formed on the outer surface of said substantially cylindrical anode, each said target material forming an annular band thereon;

means for rotating the anode about the longitudinal axis thereof;

means for selectively and controllably translating the anode linearly along the longitudinal axis;

a cathode selectively producing an electron beam impinging on an outer surface of the anode, forming a focal spot thereon so that X-rays are generated therefrom and are transmitted through the X-ray permeable window formed in the evacuated shell.

5. The X-ray tube as recited in claim 4, further comprising at least two different target materials formed on the outer surface of said substantially cylindrical anode, each said target material forming an annular band thereon.

6. The X-ray tube as recited in claim 4, wherein said means for selectively and controllable linearly translating the anode along the longitudinal axis comprises means for translating rotational motion into linear motion.

* * * * *